US009022643B2

(12) United States Patent
Nagareda et al.

(10) Patent No.: US 9,022,643 B2
(45) Date of Patent: May 5, 2015

(54) ANALOG ELECTRONIC TIMEPIECE WITH FAST-SETTING HANDS

(71) Applicant: Casio Computer Co., Ltd., Shibuya-ku, Tokyo (JP)

(72) Inventors: Hirofumi Nagareda, Tachikawa (JP); Mitsuaki Matsuo, Fussa (JP); Noriyuki Kitta, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/039,279

(22) Filed: Sep. 27, 2013

(65) Prior Publication Data

US 2014/0092714 A1 Apr. 3, 2014

(30) Foreign Application Priority Data

Sep. 28, 2012 (JP) ..... 2012-216639

(51) Int. Cl.
*G04C 3/14* (2006.01)
*G04C 9/00* (2006.01)
*G04G 5/02* (2006.01)

(52) U.S. Cl.
CPC .. *G04C 3/14* (2013.01); *G04C 9/00* (2013.01); *G04G 5/02* (2013.01)

(58) Field of Classification Search
CPC ..... G04C 3/14; G04C 9/00; G04G 5/02
USPC ..... 368/187, 188, 185, 190
See application file for complete search history.

(56) References Cited

U.S. PATENT DOCUMENTS

| | | | | |
|---|---|---|---|---|
| 4,351,042 | A | 9/1982 | Ginalski et al. | |
| 5,566,138 | A * | 10/1996 | Lombreschi et al. | 368/157 |
| 6,773,157 | B1 * | 8/2004 | Grau | 368/308 |
| 2002/0024887 | A1 * | 2/2002 | Triponez | 368/35 |
| 2002/0159338 | A1 * | 10/2002 | Ogasawara | 368/80 |
| 2003/0063526 | A1 * | 4/2003 | Masaki | 368/187 |
| 2005/0128875 | A1 * | 6/2005 | Bron | 368/21 |

(Continued)

FOREIGN PATENT DOCUMENTS

| | | | |
|---|---|---|---|
| JP | 56-082477 | A | 7/1981 |
| JP | 03-223692 | A | 10/1991 |

(Continued)

OTHER PUBLICATIONS

Japanese Office Action dated Oct. 15, 2013 (and English translation thereof) in counterpart Japanese Application No. 2012-216639.

*Primary Examiner* — Amy Cohen Johnson
*Assistant Examiner* — Matthew Powell
(74) *Attorney, Agent, or Firm* — Holtz, Holtz, Goodman & Chick PC

(57) ABSTRACT

Disclosed is an analog electronic timepiece including a first pointer which rotates freely with respect to a dial, a driving control unit which controls rotation of the first pointer, and an operation unit which receives an input operation performed by a user. In the analog electronic timepiece, the driving control unit includes an intermittent fast forwarding unit which performs a fast forwarding operation with temporary stops, where the rotation of the first pointer is stopped for a predetermined time period every time the first pointer is rotated by being fast forward for a predetermined number of steps according to a predetermined starting operation performed on the operation unit, the predetermined number of steps being 2 or more steps.

12 Claims, 6 Drawing Sheets

(56) References Cited

U.S. PATENT DOCUMENTS

| | | | | |
|---|---|---|---|---|
| 2006/0209637 | A1* | 9/2006 | May et al. | 368/223 |
| 2008/0144444 | A1* | 6/2008 | Mahler et al. | 368/76 |
| 2011/0063953 | A1* | 3/2011 | Hasegawa et al. | 368/80 |

FOREIGN PATENT DOCUMENTS

| | | | |
|---|---|---|---|
| JP | 2002-323579 | A | 11/2002 |
| JP | 2004-354349 | A | 12/2004 |

* cited by examiner

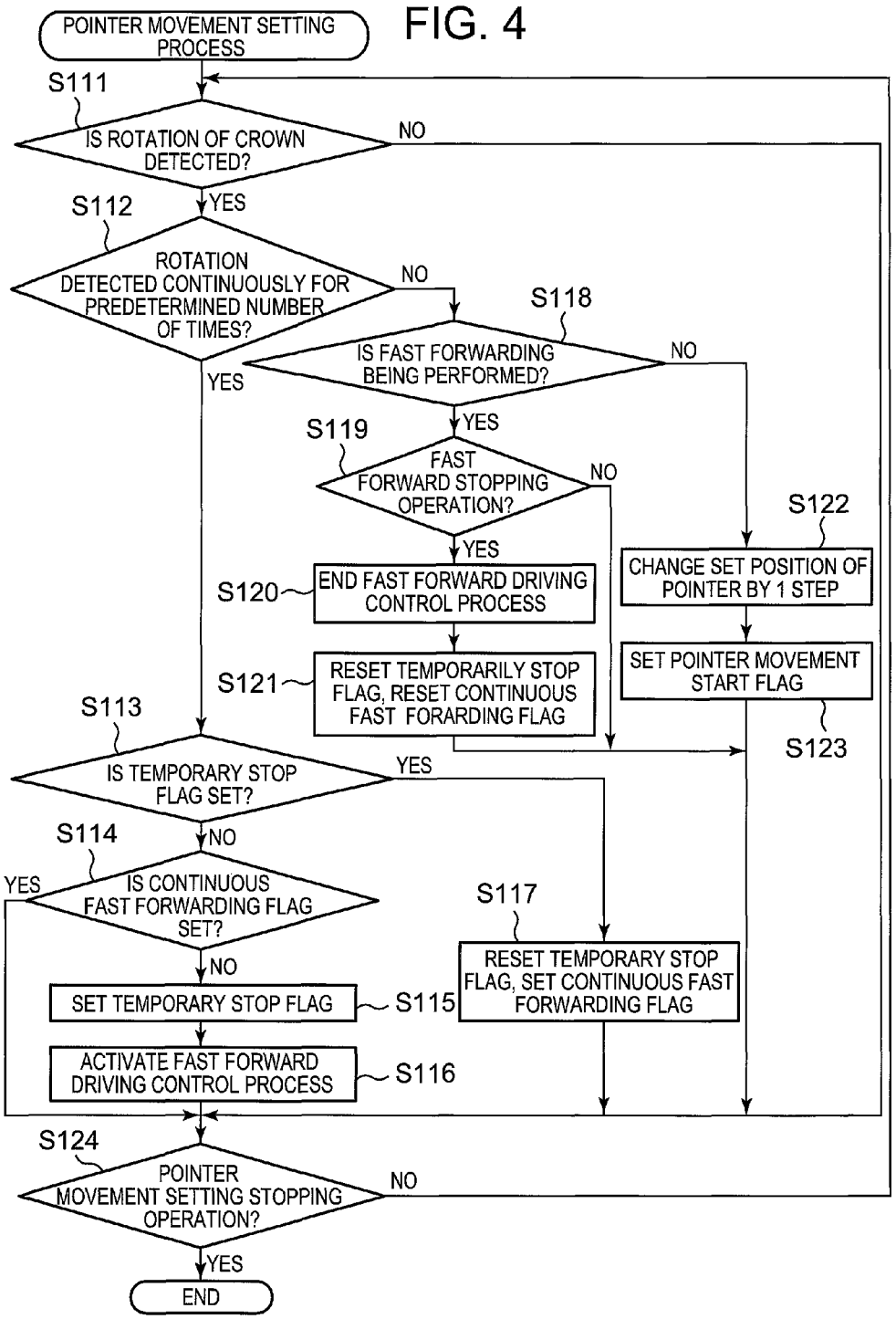
FIG. 4
POINTER MOVEMENT SETTING PROCESS
S111
IS ROTATION OF CROWN DETECTED?
NO
YES
S112
ROTATION DETECTED CONTINUOUSLY FOR PREDETERMINED NUMBER OF TIMES?
NO
YES
S118
IS FAST FORWARDING BEING PERFORMED?
NO
YES
S119
FAST FORWARD STOPPING OPERATION?
NO
YES
S120
END FAST FORWARD DRIVING CONTROL PROCESS
S121
RESET TEMPORARILY STOP FLAG, RESET CONTINUOUS FAST FORARDING FLAG
S122
CHANGE SET POSITION OF POINTER BY 1 STEP
SET POINTER MOVEMENT START FLAG
S123
S113
IS TEMPORARY STOP FLAG SET?
YES
NO
S114
IS CONTINUOUS FAST FORWARDING FLAG SET?
YES
NO
S117
RESET TEMPORARY STOP FLAG, SET CONTINUOUS FAST FORWARDING FLAG
SET TEMPORARY STOP FLAG
S115
ACTIVATE FAST FORWARD DRIVING CONTROL PROCESS
S116
S124
POINTER MOVEMENT SETTING STOPPING OPERATION?
NO
YES
END

ANALOG ELECTRONIC TIMEPIECE WITH FAST-SETTING HANDS

BACKGROUND OF THE INVENTION

1. Field of the Invention

The present invention relates to an analog electronic timepiece.

2. Description of Related Art

Analog electronic timepieces which display the time by making a plurality of pointers point predetermined positions on their dials are known. In such analog electronic timepieces, conventionally, rotors of stepping motors are rotated by applying driving pulse voltages to the stepping motors and the rotations of the rotors are transmitted to the pointers at predetermined gear ratio by gear train mechanisms, in which gears are arranged, to rotate the pointers.

In such analog electronic timepieces, each pointer can be fast forward continuously for a plurality of steps by controlling the output intervals of the driving pulse voltages. Further, in such analog electronic timepieces, the pointers are fast forward to their target positions which are set automatically according to correction to the accurate current time that is obtained through frequency reception from outside, limitation and releasing of pointers' operation according to power state and switching of display modes and operation states according to user's operation on push-button switches.

On the other hand, conventionally, analog timepieces with alarm notifying function each of which including an indication mechanism which performs the notifying operation at the alarm time corresponding to the position of the indication pointer. For example, JP 2002-323579 discloses a technique to check the discrepancy between the pointer's position and the timing of the notifying operation by fast forwarding the pointers which indicate the time up to few seconds before the alarm time set by the indication pointer and thereafter moving the pointers at normal speed when checking the notifying operation. Further, JP 2004-354349 discloses a technique wherein, when fast forwarding a pointer to a predetermined reference position, the pointer is made to respond to mechanical error of the set time due to the indication pointer by manually operating the pointer to the accurate position after setting a position detection mechanism using an indication pointer near the reference position and fast forwarding the pointer to the position of the indication pointer.

In recent years, in analog electronic timepieces, when users operate the push-button switches or the crowns to manually perform pointer movement such as data setting, the users may selectively move the pointers 1 step by 1 step by performing a predetermined operation on the push-button switches or the crowns, or may let the fast forwarding operation be performed continuously until the predetermined operation is performed again.

However, if a pointer is fast forward at high speed, it is difficult for a user to stop the fast forwarding of the pointer at the position near the desired position. That is, there may be a case where a user needs to move the pointer 1 step by 1 step from a position very far from the desired position.

An object of the present invention is to provide an analog electronic timepiece in which a pointer can be moved easily to their desired positions by a user.

SUMMARY OF THE INVENTION

According to one aspect of the present invention, there is provided an analog electronic timepiece including a first pointer which rotates freely with respect to a dial, a driving control unit which controls rotation of the first pointer and an operation unit which receives an input operation performed by a user, and the driving control unit includes an intermittent fast forwarding unit which performs a fast forwarding operation with temporary stops, where the rotation of the first pointer is stopped for a predetermined time period every time the first pointer is rotated by being fast forward for a predetermined number of steps according to a predetermined starting operation performed on the operation unit, the predetermined number of steps being 2 or more steps.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4 is a flowchart showing a control procedure of a pointer movement setting process relating to the manually moving operation of a pointer;

DESCRIPTION OF THE PREFERRED EMBODIMENTS

Hereinafter, the embodiments of the present invention will be described with reference to the drawings.

[First Embodiment]

Figure 1:
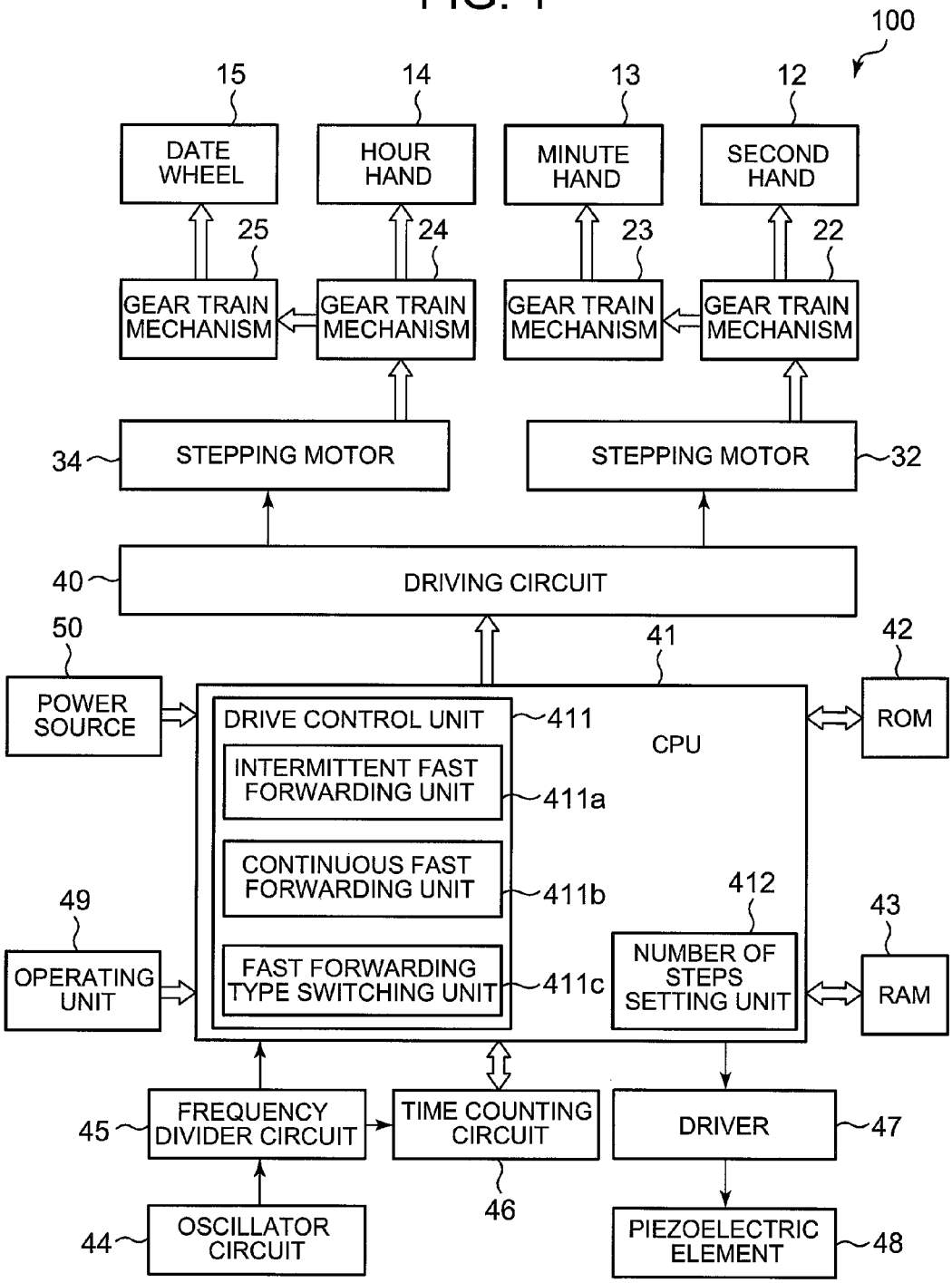
FIG. 1 is a block diagram showing an inner configuration of an analog electronic timepiece according to the first embodiment of the present invention.

FIG. 1 is a block diagram showing an inner configuration of the analog electronic timepiece 100 according to the first embodiment of the present invention.

Although it is not specifically limited, the analog electronic timepiece 100 of this embodiment is a wrist watch type timepiece, for example. The analog electronic timepiece 100 includes a second hand 12 (first pointer), a minute hand 13 (second pointer) and an hour hand 14 each of which rotates on a dial of a timepiece in increments of a predetermined angle step, a date wheel 15 which is disposed under the dial and rotates (hereinafter, the second hand 12, the minute hand 13, the hour hand 14 and the date wheel 15 may be referred to as time pointers 12 to 15 all together), gear train mechanisms 22 to 25, stepping motors 32 and 34, a driving circuit 40, a CPU 41 (Central Processing Unit) (a drive control unit 411, an intermittent fast forwarding unit 411*a*, a continuous fast forwarding unit 411*b*, a fast forwarding type switching unit 411*c*, a number of steps setting unit 412), a ROM 42 (Read Only Memory), a RAM 43 (Random Access Memory), an oscillator circuit 44, a frequency divider circuit 45, a time counting circuit 46, a piezoelectric element 48, a driver 47, an operating unit 49 (operation unit), a power source 50 and such like.

The second hand 12 rotates by the rotation of the stepping motor 32 being transmitted via the gear train mechanism 22. The minute hand 13 rotates by the rotation of a predetermined gear in the gear train mechanism 22 further being transmitted at a predetermined gear ratio via the gear train mechanism 23. That is, in the analog electronic timepiece 100, the second hand 12 and the minute hand 13 rotate in conjunction with each other in response to the rotation of the stepping motor 32. The hour hand 14 rotates by the rotation of the stepping motor 34 being transmitted via the gear train mechanism 24. Further, the date wheel 15 rotates intermittently in increments of a predetermined angle via the gear train mechanism 25 to which the rotation of a predetermined gear in the gear train mechanism 24 is transmitted in a cyclic manner at predetermined intervals. That is, in the analog electronic timepiece 100, the hour hand 14 and the date wheel 15 rotate in response to the rotation of the stepping motor 34.

The second hand 12 rotates in increments of 6 degree step by the gear train mechanism 22. In a normal time display state, the second hand 12 rotates 1 step every 1 second to go around the dial once in 60 seconds and displays the second value of the time. In this analog electronic timepiece 100 according to the embodiment, the minute hand 13 rotates 1 degree step by the gear train mechanisms 22 and 23 every time the second hand 12 rotates 10 steps (unit step number), that is, every time the second hand 12 rotates 60 degrees. In a normal time display state, the minute hand 13 rotates 1 step every 10 seconds to go around the dial once in 3600 seconds (1 hour) and displays the minute value of the time. In a case where the second hand 12 and the minute hand 13 are to be fast forward, the second hand 12 can be fast forward in the normal rotation direction or the reverse rotation direction at 64 pps (pulse per second) and the minute hand 13 rotates 1 step every time the second hand 12 rotates 10 steps.

The hour hand 14 rotates in increments of 1 degree step by the gear train mechanism 24. In a normal time display state, the hour hand 14 rotates 1 step every 2 minutes to go around the dial once in 720 minutes (12 hours) and displays the hour value of the time. In the analog electronic timepiece 100 of the embodiment, the date wheel 15 rotates with the rotation of the hour hand 14 only while the hour hand 14 goes around the dial twice, that is, only during a predetermined period of time once in 24 hours (for example, during 2 hours from 22:00). On the surface of the date wheel 15, indications "1" to "31" showing the dates are provided in a circular manner, and by any of the indications being selectively exposed to be displayed at a predetermined position on the dial, the current date is to be displayed. Every time the rotation operation of the date wheel 15 in the predetermined period of time is carried out, the date wheel 15 rotates only for the angle by which the indication of date to be exposed and displayed changes by one day. Further, when the hour hand 14 and the date wheel 15 are to be fast forward, the CPU 14 controls the rotation of the hour hand 14 so as to rotate in conjunction with the fast forwarding of the minute hand 13 and the second hand 12 while the analog electronic timepiece 100 is performing display of time such as display of the current time, the alarm set time or the timer set time. In other words, in such fast forward control, the driving control signals for driving the stepping motors 32 and 34 are output from the CPU 41 to the driving circuit 40 so that the hour hand 14 rotates 1 step every time the minute hand 13 rotates 12 steps.

Based on the driving control signals input from the CPU 14, the driving circuit 40 outputs voltage pulse signals for rotationally driving the rotors to the stepping motors 32 and 34. In the analog electronic timepiece 100, outputting of the voltage pulse signals by the driving circuit 40 is adjusted arbitrarily so that the signals are not output with respect to the plurality of pointer at the same time.

The CPU 41 performs various types of arithmetic processes and integrally controls the entire operation of the analog electronic timepiece 100. By executing control programs which are read out from the ROM 42, the CPU 41 makes various parts of the analog electronic timepiece 100 perform various functions such as the time display function.

In the ROM 42, control programs and initial setting data relating to various types of functions which are executed by the analog electronic timepiece 100 are stored. In the analog electronic timepiece 100 according to this embodiment, the operation of the alarm notifying function, the display operation of the stopwatch function and the display and operation of the timer function can be controlled by the control programs in addition to the operation of the time display function.

A part of or the entire ROM 42 may be a non-volatile memory in which data can be re-written, such as a flash memory.

The RAM 43 provides a working memory space for the CPU 41 and is a volatile memory which temporarily stores data. In the RAM 43, set position data which indicates the set positions of the time pointers 12 to 15 and pointer position data which indicates the actual positions of the time pointers 12 to 15 are stored. Moreover, in the RAM 43, a flag that indicates fast forwarding state is stored if a pointer is to be fast forward manually by a user.

The oscillator circuit 44 is a circuit for generating and outputting signals of predetermined frequencies and for example, is a crystal-oscillator circuit. The frequency divider circuit 45 divides a signal of a predetermined frequency which is output from the oscillator circuit 44 into signals of frequencies, which are set in advance, used by the CPU 41 and the time counting circuit 46. The frequency setting of such output signals can be changed by the input instruction from the CPU 41. The time counting circuit 46 counts the number of times the frequency signals are input from the frequency divider circuit 45 and counts the current time by adding the counted number of times to the initially set time.

The piezoelectric element 48 generates a buzzer sound by being activated by a voltage signal output from the driver 47 on the bases of a control signal input from the CPU 41. Such buzzer sound is used for informing the time the alarm is set and when the time period set by the timer function has elapsed, for example.

The operating unit 49 includes user interfaces such as a push-button switch and a crown. The operating unit 49 detects the input operations such as the pushing of the push-button switch, pulling out operation of the crown, rotating of the crown in the normal rotation direction or the reverse rotation direction by a predetermined angle and the like and converts them into electronic signals, and then, outputs the electronic signals to the CPU 41 as input signals. Although it is not specifically limited, such push-button switch and crown are provided on the side surface part of the wrist watch with respect to the display surface.

The power source 50 supplies power to the CPU 41 and to each part in the analog electronic timepiece 100. A configuration that is light in weight and that can supply power continuously for long period of time is used for the power source 50. For example, as for the power source 50, a solar battery and a secondary battery are used in combination. Further, a button type battery may be used or a button type battery and a solar battery can be used together.

Next, the pointer movement in the analog electronic timepiece 100 of the embodiment will be described.

In the analog electronic timepiece 100 according to this embodiment, the 1 step automatic moving operation of a pointer over time (hereinafter, the operation of the second hand 12 in the time display state will be described; however, it is controlled so that the minute hand 13 rotates automatically in conjunction with the rotation of the second hand 12 and the hour hand 14 and the date wheel 15 rotate in conjunction with the rotation of the minute hand 13), the automatic fast forwarding operation for automatically moving a pointer to its initial position which is set in advance due to switching of the function mode, the manual moving operation for moving a pointer's position by 1 step based on an input operation performed by a user on the operating unit 49 and the continuous manual fast forwarding operation can be carried out.

In the analog electronic timepiece 100, the 1 step automatic moving operation and the manually moving operation are carried out by the CPU 41 updating the set position data stored in the RAM 43. In this updating, the difference between the set position data and the pointer position data is searched in the pointer movement process which is executed regularly, and if the difference is detected, the pointer movement process for moving the time pointers 12 to 15 in compliance with their set positions is carried out.

Figure 2:
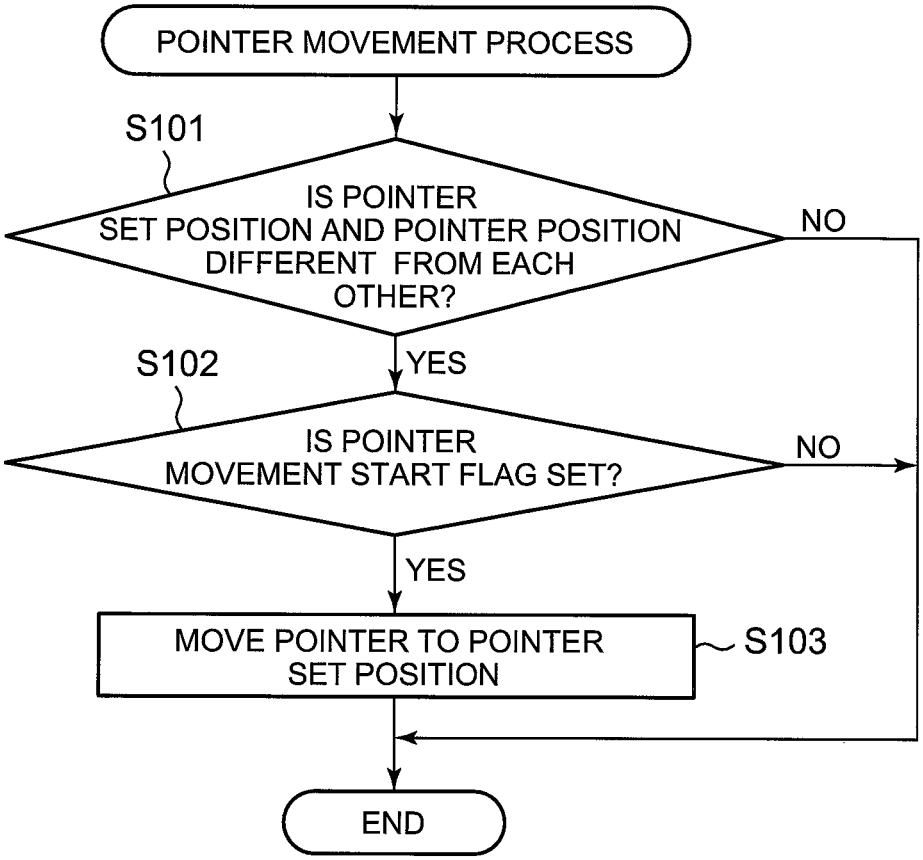
FIG. 2 is a flowchart showing a control procedure of a pointer movement process for moving a pointer for 1 step.

FIG. 2 is a flowchart showing a control procedure of the CPU 41 in the pointer movement process.

When the pointer movement process starts, the CPU 41 determines whether the set position data and the pointer position data stored in the RAM 43 are different from each other (step S101). If the CPU 41 determines that the set position data and the pointer position data are not different from each other (equal to each other) (step S101; NO), the CPU 41 ends the pointer movement process. On the other hand, if the CPU 41 determines that the set position data and the pointer position data are different from each other (step S101; YES), the CPU 41 determines whether the pointer movement start flag, which is a flag for permitting the pointer movement with respect to the internal operation, is set (step S102). If the CPU 41 determines that the pointer movement start flag is not set (step S102; NO), the CPU 41 ends the pointer movement process. If the CPU 41 determines that the pointer movement start flag is set (step S102; YES), the CPU 41 outputs a driving control signal for moving a pointer to the pointer position according to the set position data to the drive circuit 40 (step S103). Thereafter, the CPU 41 updates the pointer position data and then ends the pointer movement process.

When the continuous automatic fast forwarding operation or the manual fast forwarding operation is to be carried out, processes relating to the fast forwarding operation are called up as a group and the fast forwarding operation of a pointer is carried out preferentially. At this time, in the automatic fast forwarding operation, a pointer is fast forward continuously to the moving target position at a preset fast forwarding speed (64 pps). In the analog electronic timepiece 100 according to this embodiment, in the case where the manual fast forwarding operation is executed, either of the continuous fast forwarding mode to continuously fast forward a pointer at a preset fast forwarding speed (64 pps) until the stopping operation to stop the fast forwarding is input and the intermittent fast forwarding mode where the temporary stopping for a predetermined time period is inserted every time fast forwarding for a predetermined number of steps is performed can be carried out. In the analog electronic timepiece 100 according to this embodiment, for example, the temporary stopping for 0.5 seconds is to be inserted every time fast forwarding for 60 steps which equals to 1 cycle of the second hand, that is, every time fast forwarding of 1 minute is carried out, in the intermittent fast forwarding mode.

The number of fast forwarding steps per one fast forwarding operation in the intermittent fast forwarding mode may vary according to the input operation performed on the operating unit 49 on the basis of the convenience of each user, the moving angle of the pointer per 1 step and the like. Similarly, the length of temporary stop time period may also vary according to the input operation performed on the operating unit 49.

Here, the switching control of the moving operation of the pointer performed manually will be described.

The manual moving operation, and the manual fast forwarding operation are used when setting the alarm time and the time for timer in the setting mode of the alarm operation and in the timer function mode.

Figure 3:
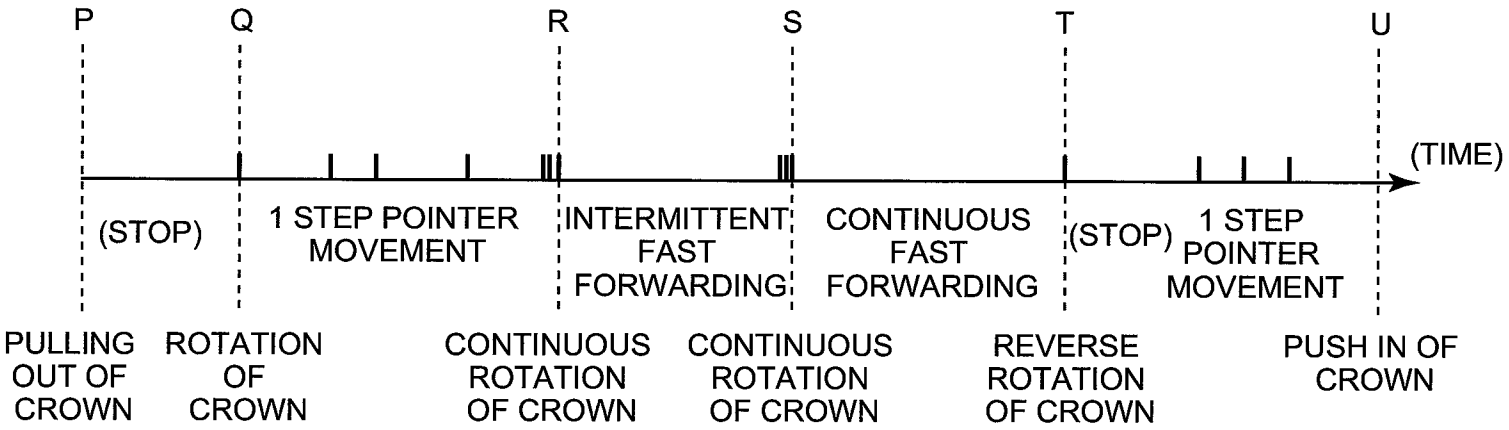
FIG. 3 is an explanatory diagram of an operation procedure of a manually moving operation of a pointer in the analog electronic timepiece according to the embodiment.

FIG. 3 is an explanatory diagram of a switching control of the moving operation of a pointer performed manually in the analog electronic timepiece 100 of the embodiment. In this diagram, the solid lines which are orthogonal with respect to the time axis (horizontal axis) indicate the timings when the crown is rotated.

In the analog electronic timepiece 100, the pulling out operation of the crown results in switching to the pointer position movable state (P). By the crown being rotated in the movable state, the manually moving operation is performed 1 step by 1 step with respect to the pointer which is the target for moving (Q to R). Next, if it is detected that the crown is rotated for a predetermined number of times (for example, 3 times) within a predetermined time period (for example, 0.5 seconds) (a predetermined start operation), the mode is switched to the intermittent fast forwarding mode (R). Further, if it is detected that the crown is rotated for a predetermined number of times within a predetermined time period in the intermittent fast forwarding mode, the mode is switched to the continuous fast forwarding mode (S). If the crown is rotated in the direction opposite to the fast forwarding direction of the crown in the intermittent fast forwarding mode or in the continuous fast forwarding mode, the manual fast forwarding operation is ended (T). Thereafter, the pointer can be moved again (T~U) and finally, by the crown being pushed in, the movable state is released (U).

FIG. 4 is a flowchart showing a control procedure of the CPU 41 in the pointer movement setting process, the pointer movement setting process being started by the crown being pulled out.

When the pointer movement setting process starts, the CPU 41 first determines whether the rotation of the crown is detected (step S111). If the CPU 41 determines that the rotation of the crown is not detected (step S111; NO), the process of the CPU 41 moves on to step S124. If the CPU 41 determines that the rotation of the crown is detected (step S111; YES), the CPU 41 next determines whether the detected rotation of the crown is the rotation of the $n^{th}$ time (third time) within a predetermined time period (0.5 seconds) before the detection (step S112).

If the CPU 41 determines that the detection is the rotation of the $n^{th}$ time (step S112; YES), the CPU 41 determines whether the temporary stop flag, which indicates the intermittent fast forwarding mode, is set (step S113). If the CPU 41 determines that the temporary stop flag is not set (step S113; NO), the CPU 41 then determines whether the continuous fast forwarding flag, which indicates the continuous fast forwarding mode, is set (step S114). If the CPU 41 determines that the continuous fast forwarding flag is not set (step S114; NO), this indicates that the pointer is not being fast forward and the CPU 41 activates the after-mentioned fast forward driving control process (step S116) after setting the temporary stop flag (step S115). Thereafter, the process of the CPU 41 moves on to the step S124. If the CPU 41 determines that the continuous fast forwarding flag is set (step S114; YES), this indicates that the fast forward driving control process is already activated and that the mode is the continuous fast forwarding mode; therefore, the process of the CPU 41 moves on to step S124.

If the CPU 41 determines that the temporary stop flag is set in the determination process of step S113 (step S113; YES), this indicates that the fast forward driving control process is already activated and that the mode is the intermittent fast forwarding mode; therefore, the CPU 41 resets the temporary stop flag and sets the continuous fast forwarding flag to switch the mode to the continuous fast forwarding mode (step S117). Thereafter, the process of CPU 41 moves on to step S124.

If the CPU 41 determines that the rotation of the $n^{th}$ time, the rotation being continuous, is not detected in the determination process of step S112 (step S112; NO), the CPU 41 then determines whether fast forwarding is performed currently (step S118). If the CPU 41 determines that fast forwarding is performed currently, that is, that the process is in the intermittent fast forwarding mode or the continuous fast forwarding mode (step S118; YES), the CPU 41 determines whether the detected operation of the crown is the fast forward stopping operation (step S119). In particular, the CPU 41 determines whether the crown is rotated in the direction opposite of the fast forwarding direction of the crown. If the CPU 41 determines that the detected operation of the crown is the fast forward stopping operation (step S119; YES), the CPU 41 ends the fast forward driving control process which is currently running (step S120). Further, the CPU 41 resets the temporarily stop flag and the continuous fast forwarding flag (step S121). Thereafter, the process of the CPU 41 moves on to step S124. If the CPU 41 determines that the detected operation of the crown is not the fast forward stopping operation (step S119; NO), the process of the CPU 41 moves on to step S124.

If the CPU 41 determines that fast forwarding is not performed currently in the determination process of step S118 (step S118; NO), the CPU 41 moves the set position data of the pointer (second hand 12) stored in the RAM 43 for 1 step in the normal rotation direction or in the reverse rotation direction according to the rotation direction of the crown (step S122) and sets the pointer movement start flag (step S123). Thereafter, the process of the CPU 41 moves on to step S124.

When the process moves on to step S124 from step S111, S114, S116, S117, S119, S121 or S123, the CPU 41 determines whether the pointer movement setting stopping operation is detected. That is, the CPU 41 determines whether the push back operation of the crown is detected. If the CPU 41 determines that the push back operation of the crown is not detected (step S124; NO), the process of the CPU 41 returns to step S111. If the CPU 41 determines that the pointer movement setting stopping operation is detected (step S124; YES), the CPU 41 ends the pointer movement setting process.

Figure 5:
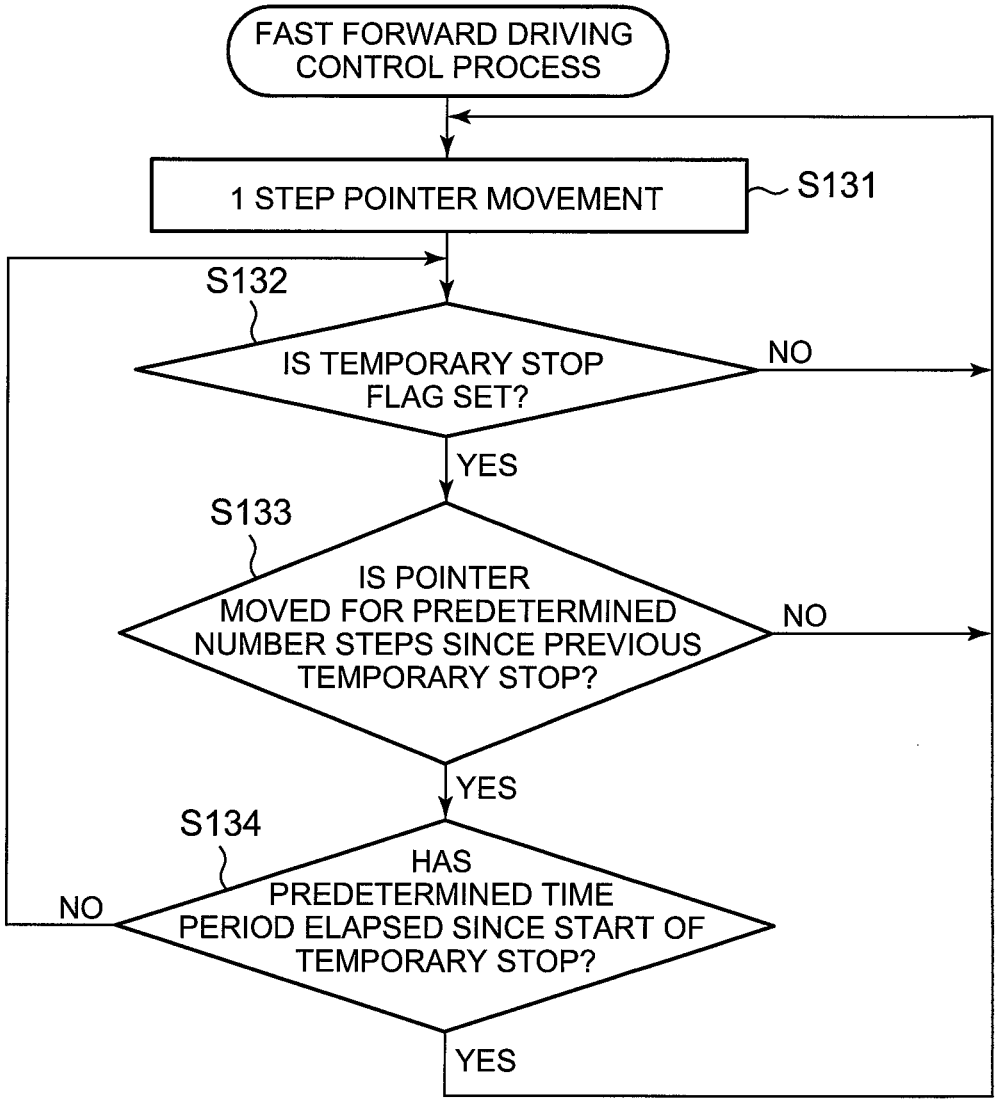
FIG. 5 is a flowchart showing a control procedure of a fast forward driving control process which is activated in an operation setting process.

FIG. 5 is a flowchart showing a control procedure of the CPU 41 in the fast forward driving control process which is activated in the pointer movement setting process.

The fast forward driving control process is activated when the process of step S116 in the pointer movement setting process is performed and is continuously executed in parallel with the pointer movement setting process until the ending operation is performed in the process of step S120 or until the ending operation is performed externally such as force-quit being performed by pushing back the crown, for example.

When the fast forward driving control process is activated, the CPU 41 first moves the pointer by 1 step by outputting a driving control signal to the driving circuit 40 (step S131). Next, the CPU 41 determines whether the temporary stop flag is set (step S132). If the CPU 41 determines that the temporary stop flag is not set (step S132; NO), the process of the CPU 41 returns to step S131 and the next driving control signal is output at a predetermined driving speed (interval).

If the CPU 41 determines that the temporary stop flag is set (step S132; YES), the CPU 41 next determines whether the pointer is moved for a predetermined number of steps (for example, 60 steps) which is preset after the previous temporary stop of the fast forwarding of the pointer (step S133). If the CPU 41 determines that the pointer is not moved for the predetermined number of steps (step S133; NO), the process of the CPU 41 returns to step S131 and the next driving control signal is output at the predetermined driving speed (interval).

If the CPU 41 determines that the pointer is moved for the predetermined number of steps (step S133; YES), the CPU 41 next determines whether a predetermined time period (for example, 0.5 seconds) has elapsed since the start of the current temporary stop (step S134). Here, if the temporary stop is not started yet, the CPU 41 starts to count the elapse time. If the CPU 41 determines that the predetermined time period has elapsed (step S134; YES), the process of the CPU 41 returns to step S131 and the next driving control signal is output again at the predetermined driving speed (interval). On the other hand, if the CPU 41 determines that the predetermined time period has not elapsed (step S134; NO), the process of the CPU 41 returns to step S132. That is, during the predetermined time period, the CPU 41 does not output the driving control signal to the driving circuit 40.

As described above, the fast forward driving control process is executed in parallel with the pointer movement setting process. Therefore, if the setting of the temporary stop flag is changed in the pointer movement setting process, the result of the determination process of step S132 in the fast forward driving control process is also changed immediately and the fast forwarding operation of the pointer switches to the continuous fast forwarding mode from the intermittent fast forwarding mode.

As described above, the analog electronic timepiece 100 according to the first embodiment includes the second hand 12 which is provided so as to rotate freely with respect to the dial, the CPU 41 which controls the rotation of the second hand 12 and the operating unit 49 including the crown. Based on the rotation of the crown, the CPU 41 performs the fast forward driving control in the intermittent fast forwarding mode wherein the fast forwarding is temporarily stopped for a predetermined period of time every time the second hand 12 is fast forward for a predetermined number of steps. Therefore, occurrence of a circumstance such that the fast forwarding of the second hand 12 tends to stop when the second hand 12 is at the position greatly shifted from the desired position due to a user not being able to end the fast forwarding at a good timing can be reduced.

Further, the possibility of a user unintentionally rotating the crown continuously when trying to move the second hand 12 for a plurality of steps and moving the second hand 12 to the position greatly apart from the desired position can be reduced. Moreover, even when the fast forwarding is performed mistakenly, the second hand 12 can be easily returned to the original position by fast forwarding the second hand 12 in the intermittent fast forwarding mode in the reverse direction, similarly. Therefore, the pointer's position can be corrected more easily.

The intermittent fast forwarding is repeated automatically by the CPU 41 and there is no need for a user to repeat the fast forwarding in increments of a predetermined number steps.

Therefore, a user can be saved from further troubles of performing operations relating to starting of fast forwarding.

Moreover, based on the rotation of the crown, the CPU 41 can fast forward the second hand 12 in the continuous fast forwarding mode without temporary stops in the fast forward driving control and either of the intermittent fast forwarding mode and the continuous fast forwarding mode can be selected by a user performing an operation to perform the fast forwarding. Therefore, in order to perform fast forwarding in the intermittent fast forwarding mode, the pointer can be continuously moved close to the desired position first when moving the pointer by a large number of steps. Therefore, the moving time period of the second hand 12 can be shortened.

When manually moving the second hand 12, the mode is first switched to the intermittent fast forwarding mode from the fast forwarding of 1 step by 1 step and then switched to the continuous fast forwarding mode. Therefore, as described above, the mode can be switched to the continuous fast forwarding mode promptly as needed while dealing with the unintentional fast forwarding.

Especially, when the minute hand 13 rotates in conjunction with the second hand 12 by the gear train mechanisms 22 and 23, the minute hand 13 and the second hand 12 can be moved to their target positions easily even if it is necessary to rotate the second hand 12 by performing fast forwarding for a plurality of times in order to move the minute hand 13.

Further, by intermittently fast forwarding the pointer in increments of the number of steps corresponding to the operation intervals of the minute hand 13, a user can easily determine how much more the intermittent fast forwarding need to be performed and the fast forwarding can be ended at an appropriate timing.

Especially, because fast forwarding of the display time and the time period is performed intermittently at intervals of 1 cycle of the second hand 12, that is, at intervals of 1 minute, a user can easily determine the number of time the intermittent fast forwarding is to be performed and can stop the second hand 12 and the minute hand 13 at the appropriate positions.

Further, because the predetermined number of steps in the intermittent fast forward mode can vary according to the tendency of a user in the crown operation and according to the number of steps each user feels adequate for moving the pointer in each step. Therefore, a user can fast forward the pointer to the desired position easily.

[Second Embodiment]

Figure 6:
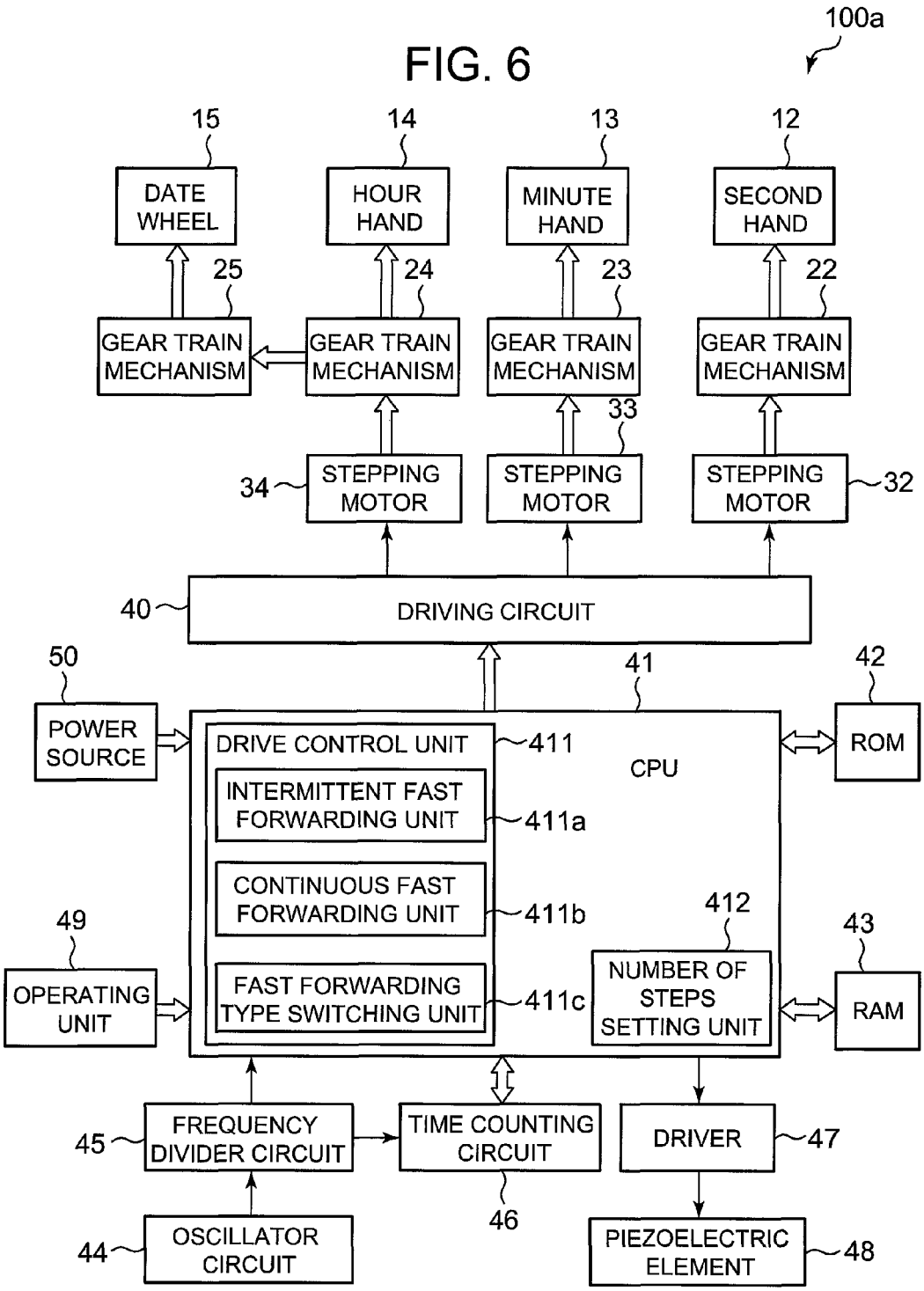
FIG. 6 is a block diagram showing an inner configuration of an analog electronic timepiece according to the second embodiment.

FIG. 6 is a block diagram showing an inner configuration of the analog electronic timepiece 100*a* according to the second embodiment.

In the analog electronic timepiece 100*a* according to the second embodiment, the stepping motor 32 only rotates the second hand 12 via the gear train mechanism 22 and the newly added stepping motor 33 independently rotates the minute hand 13 via the gear train mechanism 23. Other than this configuration, the analog electronic timepiece 100*a* according to the second embodiment has the configuration similar to that of the analog electronic timepiece 100 according to the first embodiment. With respect to the similar configuration, like symbols are used and the description is omitted.

Control procedures in the manually moving operation of a pointer (second hand 12) in the analog electronic timepiece 100*a* according to the second embodiment is similar to those shown in FIGS. 2 to 5 and the descriptions are omitted.

In a case where the rotation of the second hand 12 and the rotation of the minute hand 13 can be performed independently, the operation timing of the minute hand 13 in the time display and the time period display is controlled based on the number of times the second hand 12 is rotated (position information). Therefore, also in a case where the time display and the time period display are to be fast forward, the CPU 41 is to similarly output the driving control signals for rotating the minute hand 13 according to the number of times the second hand 12 is rotated to the driving circuit 40.

With respect to the individual pointer (second hand 12), the intermittent fast forwarding operation and the continuous fast forwarding operation may be performed independently. For example, if the analog electronic timepiece 100*a* can display the times of the cities of the world and the city whose time is to be displayed is set according to the position where the second hand 12 points, the second hand 12 can be set so as to be fast forward intermittently in increments of the number of steps corresponding to changing of the city whose time is to be displayed by one city or by a plurality of cities (for example, 5 steps).

In such way, according to the analog electronic timepiece 100*a* of the second embodiment, even in the case where the second hand 12 and the minute hand 13 are driven separately by the stepping motors 32 and 33, respectively, the fast forwarding of the second hand 12 can be ended when the second hand 12 is positioned at a position near the desired position more easily by similarly being able to fast forward the second hand 12 in the intermittent fast forwarding mode.

Further, by the rotation timing being controlled in conjunction with and matching with the displayed time and time period and by performing the intermittent fast forwarding in increments of the number of steps corresponding to the operation interval of the minute hand 13, a user can easily determine how much more the intermittent fast forwarding need to be performed.

The present invention is not limited to the above described embodiment, and various modifications can be carried out.

For example, although the intermittent fast forwarding mode and the continuous fast forwarding mode are set in the above embodiments, only the intermittent fast forwarding mode can be set when fast forwarding is to be performed manually.

Further, in the abode described embodiments, the description is given for the processing example where an operation other than the fast forward stopping operation cannot be performed once the mode is switched to the continuous fast forwarding mode from the intermittent fast forwarding mode. However, the mode may be returned again to the intermittent fast forwarding mode from the continuous fast forwarding mode.

Moreover, in the above embodiments, the pointer is moved by the rotation of the crown. However, the pointer may be moved by other operating interfaces such as pushing of a push-button switch, for example. Further, different push-button switches may be used between the case of 1 step movement, the case of fast forwarding and according to the moving direction of the pointer, or the push-button switch and the crown can be used together.

Further, in the above embodiment, the configuration example where the second hand 12 and the minute hand 13 rotate in conjunction with each other is described. However, the present invention is not limited to such configuration, and the configuration may be such that the minute hand 13 and the hour hand 14 rotate in conjunction with each other, for example. Moreover, in the above embodiment, the case where the second hand 12 and the minute hand 13 rotate individually is described. However, the configuration may be such that the hour hand 14 and the date wheel 15 rotate individually. For example, the hour hand 14 may be intermittently fast forward or continuously fast forward individually, and in the intermittent fast forwarding, temporary stop may be inserted every time the hour hand 14 is fast forward for 60 minutes (30 steps).

Moreover, in the above embodiment, temporary stop is inserted every time the second hand 12 is fast forward for 60 steps in compliance with one cycle of the second hand 12 in the intermittent fast forward mode. However, with respect to the setting method of the predetermined number of steps, it is not limited to such reference. For example, temporary stop may be inserted every time the second hand 12 is fast forward for 10 steps corresponding to the 1 step movement of the minute hand 13 or temporary stop may be inserted every time the second hand 12 is fast forward for 15 steps, which is a user's preference, regardless of the minute hand 13's operation.

Further, in the above embodiments, the wrist watch type analog electronic timepiece is described. However, the present invention can be applied to pocket watches and clocks.

The specific details such as configurations, arrangements and operation controls described in the above embodiments may be modified arbitrarily within the scope of the present invention.

The entire disclosure of Japanese Patent Application No. 2012-216639 filed on Sep. 28, 2012 including description, claims, drawings and abstract are incorporated herein by reference in its entirety.

What is claimed is:

1. An analog electronic timepiece, comprising:

a first pointer which rotates freely with respect to a dial;

a driving control unit which controls rotation of the first pointer; and an operation unit which receives an input operation performed by a user, wherein the driving control unit comprises:

an intermittent fast forwarding unit which performs a fast forwarding operation with temporary stops, in which the rotation of the first pointer is stopped for a predetermined time period every time the first pointer is rotated by being fast forwarded by a stepper motor for a predetermined number of steps in response to a predetermined starting operation performed on the operation unit, the predetermined number of steps being 2 or more steps;

a continuous fast forwarding unit which performs a fast forwarding operation where the first pointer is rotated by being fast forward continuously without the temporary stops according to a predetermined starting operation performed on the operation unit; and a fast forwarding type switching unit which switches between the fast forwarding operation performed by the intermittent fast forwarding unit and the fast forwarding operation performed by the continuous fast forwarding unit according to an input operation performed on the operation unit.

2. The analog electronic timepiece according to claim 1, further comprising:

a second pointer which is provided via a gear train mechanism so as to rotate 1 step every time the first pointer rotates for a predetermined number of step units, wherein the predetermined number of steps is set to a number which is an integral multiple of the number of step units.

3. The analog electronic timepiece according to claim 2, wherein the predetermined number of steps is set to a number of steps necessary for the first pointer to go around the dial once.

4. The analog electronic timepiece according to claim 1, further comprising a second pointer which is provided so as to rotate freely with respect to the dial, wherein the driving control unit rotates the second pointer for 1 step every time the first pointer is rotated for a predetermined number of step units, and the predetermined number of steps is set to a number which is an integral multiple of the number of step units.

5. The analog electronic timepiece according to claim 4, wherein the predetermined number of steps is set to a number of steps necessary for the first pointer to go around the dial once.

6. The analog electronic timepiece according to claim 1, further comprising a number of steps setting unit which, based on an input operation performed on the operation unit, sets the predetermined number of steps for a case in which the first pointer is fast forwarded by the intermittent fast forwarding unit.

7. An analog electronic timepiece, comprising:

a first pointer which rotates freely with respect to a dial;

a driving control unit which controls rotation of the first pointer; and an operation unit which receives an input operation performed by a user, wherein the driving control unit comprises:

an intermittent fast forwarding unit which performs a fast forwarding operation with temporary stops, in which the rotation of the first pointer is stopped for a predetermined time period every time the first pointer is rotated by being fast forwarded by a stepper motor for a predetermined number of steps in response to a predetermined starting operation performed on the operation unit, the predetermined number of steps being 2 or more steps; and a continuous fast forwarding unit which performs a fast forwarding operation to rotate the first pointer by fast forwarding the first pointer continuously without the temporary stops, wherein when the predetermined starting operation is detected while the fast forwarding operation is not performed, the driving control unit starts the fast forwarding operation by the intermittent fast forwarding unit, and wherein when a predetermined starting operation is detected while the fast forwarding operation by the intermittent fast forwarding unit is performed, the driving control unit switches to the fast forwarding operation by the continuous fast forwarding unit.

8. The analog electronic timepiece according to claim 7, further comprising:

a second pointer which is provided via a gear train mechanism so as to rotate 1 step every time the first pointer rotates for a predetermined number of step units, wherein the predetermined number of steps is set to a number which is an integral multiple of the number of step units.

9. The analog electronic timepiece according to claim 8, wherein the predetermined number of steps is set to a number of steps necessary for the first pointer to go around the dial once.

10. The analog electronic timepiece according to claim 7, further comprising a second pointer which is provided so as to rotate freely with respect to the dial, wherein the driving control unit rotates the second pointer for 1 step every time the first pointer is rotated for a predetermined number of step units, and the predetermined number of steps is set to a number which is an integral multiple of the number of step units.

11. The analog electronic timepiece according to claim 10, wherein the predetermined number of steps is set to a number of steps necessary for the first pointer to go around the dial once.

12. The analog electronic timepiece according to claim 7, further comprising a number of steps setting unit which, based on an input operation performed on the operation unit, sets the predetermined number of steps for a case in which the first pointer is fast forwarded by the intermittent fast forwarding unit.

* * * * *